US011578916B2

(12) United States Patent
Zhao et al.

(10) Patent No.: US 11,578,916 B2
(45) Date of Patent: Feb. 14, 2023

(54) METHOD AND DEVICE FOR PRODUCING AIR PRODUCT BASED ON CRYOGENIC RECTIFICATION

(71) Applicants: L'Air Liquide, Societe Anonyme pour l'Etude et l'Exploitation des Procedes Georges Claude, Paris (FR); Bowei Zhao, Hangzhou (CN); Alain Briglia, Hangzhou (CN); Fengjie Xue, Hangzhou (CN)

(72) Inventors: Bowei Zhao, Hangzhou (CN); Alain Briglia, Hangzhou (CN); Fengjie Xue, Hangzhou (CN)

(73) Assignee: L'Air Liquide, Societe Anonyme Pour L'Etude Et L'Exploitation Des Procedes Georqes Claude, Paris (FR)

( * ) Notice: Subject to any disclaimer, the term of this patent is extended or adjusted under 35 U.S.C. 154(b) by 208 days.

(21) Appl. No.: 16/958,809

(22) PCT Filed: Dec. 29, 2017

(86) PCT No.: PCT/CN2017/119773
§ 371 (c)(1),
(2) Date: Jun. 29, 2020

(87) PCT Pub. No.: WO2019/127343
PCT Pub. Date: Jul. 4, 2019

(65) Prior Publication Data
US 2021/0071948 A1 Mar. 11, 2021

(51) Int. Cl.
*F25J 3/04* (2006.01)

(52) U.S. Cl.
CPC ..... *F25J 3/04018* (2013.01); *F25J 3/0403* (2013.01); *F25J 3/0409* (2013.01); *F25J 3/04357* (2013.01); *F25J 3/04412* (2013.01)

(58) Field of Classification Search
CPC .... F25J 3/0403; F25J 3/04078; F25J 3/04084; F25J 3/04018; F25J 3/0409;
(Continued)

(56) References Cited

U.S. PATENT DOCUMENTS 4,555,256 A * 11/1985 Skolaude ..... F25J 3/0409 62/646
5,257,504 A * 11/1993 Agrawal ..... F25J 3/04018 62/646
(Continued)

FOREIGN PATENT DOCUMENTS

CN 1 407 303 4/2003
CN 101 886 870 11/2010
(Continued)

OTHER PUBLICATIONS

International Search Report and Written Report for PCT/CN2017/119773, dated Jul. 25, 2018.

*Primary Examiner* — Frantz F Jules
*Assistant Examiner* — Webeshet Mengesha
(74) *Attorney, Agent, or Firm* — Justin K. Murray

(57) ABSTRACT

A method and a device for producing an air product based on cryogenic rectification; after being cooled by a main heat exchanger, raw material air and nitrogen compressed by means of a compressor are sent to a rectification system for low temperature separation. In the rectification system, products such as oxygen and nitrogen are obtained by means of low temperature separation, and oxygen-enriched liquid air is obtained at or near the bottom of a rectification tower. The oxygen-enriched liquid air or liquid-state air in the rectification system is sent out after being raised to a target pressure by means of a low temperature liquid air pump; air products of various pressures can be produced by means of selecting low temperature liquid air pumps with different lifts or by connecting in series different amounts of low
(Continued)

temperature liquid air pumps. The present method can avoid the need to arrange additional air compressors, entirely changing the method for producing medium and high pressure air products in a nitrogen circulation process, and importantly can reduce production costs significantly whilst having greater flexibility. In addition, the present method can increase the oxygen extraction rate of an apparatus, thereby improving the energy efficiency level.

17 Claims, 2 Drawing Sheets

(58) Field of Classification Search
CPC .. F25J 3/04327; F25J 3/04393; F25J 3/04878; F25J 3/04496
See application file for complete search history.

(56) References Cited

U.S. PATENT DOCUMENTS

| | | | | |
|---|---|---|---|---|
| 5,666,823 | A * | 9/1997 | Smith | F25J 3/0409 62/646 |
| 6,082,135 | A | 7/2000 | Duke et al. | |
| 2008/0223075 | A1 * | 9/2008 | Tranier | F25J 3/0409 62/644 |
| 2012/0216520 | A1 * | 8/2012 | Chen | F01K 3/004 60/412 |

FOREIGN PATENT DOCUMENTS

| | | | | |
|---|---|---|---|---|
| CN | 102 721 263 | | 10/2012 | |
| CN | 203 928 597 | | 11/2014 | |
| CN | 106 440 659 | | 2/2017 | |
| EP | 2 447 653 | | 5/2012 | |
| EP | 2447653 | A1 * | 5/2012 | F25J 3/04084 |
| EP | 2963367 | A1 * | 1/2016 | F25J 3/04018 |

* cited by examiner

METHOD AND DEVICE FOR PRODUCING AIR PRODUCT BASED ON CRYOGENIC RECTIFICATION

CROSS REFERENCE TO RELATED APPLICATIONS

This application is a § 371 of International PCT Application PCT/CN2017/119773, filed Dec. 29, 2017, which is herein incorporated by reference in its entirety.

TECHNICAL FIELD OF THE INVENTION

The present invention relates to the field of cryogenic air separation, in particular to a method and apparatus for producing an air product on the basis of cryogenic rectification.

BACKGROUND OF THE INVENTION

Cryogenic separation, also known as cryogenic rectification, was invented in 1902 by Professor Linde. It is essentially a gas liquefaction technique. Generally using a mechanical method such as throttling expansion or adiabatic expansion, gases are compressed and cooled, then the differences in boiling points of different gases are used to perform rectification, such that the different gases are separated.

The principle of cryogenic air separation is to take air as a starting material, and after compression and purification, heat exchange is used to liquefy the air to liquid air. Liquid air is mainly a mixture of liquid oxygen and liquid nitrogen; using the difference in boiling points of liquid oxygen and liquid nitrogen, they are separated by rectification to obtain nitrogen gas and oxygen gas.

In specific coal chemical industry projects, especially synthetic ammonia factories, there is often a need for large amounts of nitrogen gas products; in such situation, the use of a nitrogen gas circulation process in cryogenic air separation is more appropriate, and has therefore become generally popular. However, in a nitrogen gas circulation process, due to the lack of an air booster, if there was a need to produce an air product of medium-to-high pressure then the usual method adopted in the past was to use an independent air booster, thus the production cost was greatly increased.

SUMMARY OF THE INVENTION

An object of certain embodiments of the present invention is to provide a method and apparatus for producing an air product on the basis of cryogenic rectification, in order to vastly reduce production costs while providing greater production flexibility.

To achieve the abovementioned object, the present invention provides a method for producing an air product on the basis of cryogenic rectification, comprising:

(a) providing a first tower and a second tower, the top of the first tower being in communication by heat exchange with the bottom of the second tower by means of a main condensing evaporator, and an operating pressure of the first tower being higher than an operating pressure of the second tower;

(b) providing at least one main air compressor, an air pre-cooling system, an air purification system, at least one main heat exchanger, at least one nitrogen gas compressor, a supercooler, and at least one nitrogen gas expander;

(c) subjecting air feed gas which has been pressurized via the main air compressor to further pre-cooling and purification, then cooling same in the main heat exchanger and then sending same into the first tower to undergo rectification;

(d) extracting first nitrogen gas at the top of the first tower or second tower, reheating same via the main heat exchanger, then pressurizing same via at least one nitrogen gas compressor to form second nitrogen gas; at least a portion of the second nitrogen gas being cooled in the main heat exchanger to form first liquid nitrogen, which is depressurized via a depressurization device to form second liquid nitrogen which is sent into the top of the first tower and/or second tower; at least another portion of the second nitrogen gas being partially cooled in the main heat exchanger to form third nitrogen gas, which is expanded via a first nitrogen gas expander and then sent into the top of the first tower and/or second tower;

(e) extracting first oxygen-rich liquid air from the first tower, supercooling same via the supercooler, and then sending same into the second tower as reflux liquid;

wherein second oxygen-rich liquid air or liquid air is extracted from the first tower and pressurized via a first pump, then undergoes heat exchange with the second nitrogen gas in the main heat exchanger, and an air product is then outputted.

Optionally, the second oxygen-rich liquid air or liquid air is pressurized to different pressure ranges by using first pumps with different hydraulic heads, in order to output air products in different pressure ranges.

Optionally, the second oxygen-rich liquid air or liquid air is pressurized to different pressure ranges by connecting different numbers of first pumps in series, in order to output air products in different pressure ranges.

Optionally, a portion of the second liquid nitrogen is led out to the first pump via a regulator valve, for the purpose of being mixed with the second oxygen-rich liquid air or liquid air in a suitable ratio, thereby adjusting the nitrogen-oxygen ratio in the outputted air product.

Optionally, liquid oxygen is extracted in the main condensing evaporator, pressurized via a second pump and then sent into the main heat exchanger to be vaporized, and an oxygen gas product is then outputted.

Optionally, a portion of the second liquid nitrogen is led out, supercooled via the supercooler and then sent into the top of the second tower.

Optionally, impure liquid nitrogen is extracted at a middle region of the first tower, supercooled via the supercooler and then sent into the second tower as reflux liquid; impure nitrogen gas is extracted from the second tower, heated via the supercooler, and then further sent into the main heat exchanger for reheating; fourth nitrogen gas is extracted from the top of the second tower, heated via the supercooler, and then further sent into the main heat exchanger for reheating.

Optionally, the depressurization device is a second nitrogen gas expander and/or a throttle valve.

Optionally, the first nitrogen gas expander is braked by means of the nitrogen gas compressor; the second nitrogen gas expander is braked by means of a generator.

In addition, the present invention further provides an apparatus for producing an air product on the basis of cryogenic rectification, comprising:

(a) a first tower and a second tower, the top of the first tower being in communication by heat exchange with the bottom of the second tower by means of a main condensing evaporator, and an operating pressure of the first tower being higher than an operating pressure of the second tower;

(b) at least one main air compressor, an air pre-cooling system, an air purification system, at least one main heat exchanger, at least one nitrogen gas compressor, a supercooler, and at least one nitrogen gas expander;

(c) a pipeline which connects air feed gas into the first tower via the main air compressor, the air pre-cooling system, the air purification system and the main heat exchanger;

(d) a pipeline which connects first nitrogen gas from the top of the first tower or second tower into the top of the first tower and/or second tower via the main heat exchanger, at least one nitrogen gas compressor, via the main heat exchanger again, and respectively via a first nitrogen gas expander or a depressurization device;

(e) a pipeline which connects first oxygen-rich liquid air from the first tower into the second tower via the supercooler;

wherein the apparatus further comprises a pipeline which outputs second oxygen-rich liquid air or liquid air from the first tower via a first pump and the main heat exchanger.

Optionally, the apparatus further comprises a pipeline which is connected between an outlet of the depressurization device and an inlet of the first pump and contains a regulator valve.

Optionally, the apparatus further comprises a pipeline which outputs liquid oxygen from the main condensing evaporator via a second pump and the main heat exchanger.

Optionally, the apparatus further comprises a pipeline which is led out from an outlet of the depressurization device and connected into the top of the second tower via the supercooler.

Optionally, the apparatus further comprises a pipeline which connects impure liquid nitrogen from a middle region of the first tower into the second tower via the supercooler, a pipeline which connects impure nitrogen gas from the second tower into the main heat exchanger via the supercooler, and a pipeline which connects fourth nitrogen gas from the top of the second tower into the main heat exchanger via the supercooler.

Optionally, the depressurization device is a second nitrogen gas expander and/or a throttle valve.

Optionally, the first nitrogen gas expander is connected to the nitrogen gas compressor; the second nitrogen gas expander is connected to a generator.

Optionally, the main heat exchanger comprises a high-pressure plate heat exchanger and a low-pressure plate heat exchanger, or an integral combined heat exchanger.

In the present invention, air feed gas and nitrogen gas compressed via compressors (the main air compressor and nitrogen gas compressor) are cooled via the main heat exchanger (high-pressure plate heat exchanger and low-pressure plate heat exchanger, or integral combined heat exchanger), and then sent into the rectification system to undergo cryogenic separation.

In the rectification system (first tower, second tower and main condensing evaporator), products such as nitrogen and oxygen are obtained by cryogenic separation, and at the same time, oxygen-rich liquid air will be obtained at the bottom of, or close to, the rectification towers.

Oxygen-rich liquid air or liquid air from the first tower are raised to a target pressure via a cryogenic liquid air pump (the first pump) and then outputted; the pressure may be medium pressure or high pressure, or even ultra-high pressure. Air products of various pressures may be produced by selecting cryogenic liquid air pumps with different hydraulic heads or connecting different numbers of cryogenic liquid air pumps in series.

In the main heat exchanger, this stream of medium-pressure/high-pressure/ultra-high-pressure oxygen-rich liquid air or liquid air undergoes heat exchange with high-pressure nitrogen gas (second nitrogen gas) pressurized by the nitrogen gas compressor, to obtain a medium-pressure/high-pressure/ultra-high-pressure air product.

If it is necessary to adjust the nitrogen-oxygen ratio in the air product, the required nitrogen-oxygen ratio can be obtained by mixing with liquid nitrogen (second liquid nitrogen) from the depressurization device in a suitable ratio.

Compared with the prior art, the present invention has the following beneficial effects:

The present invention uses a liquid pump to increase the pressure of oxygen-rich liquid air or liquid air, which is then vaporized by high-pressure nitrogen gas in the main heat exchanger, thereby obtaining the required medium-to-high-pressure air product. Using such a method, it is possible to avoid being forced to provide an additional air booster, so the method for producing a medium-to-high-pressure air product in a nitrogen gas circulation process is completely changed. The importance thereof lies in its ability to greatly reduce production costs, while also being able to have greater flexibility. At the same time, using such a method, the oxygen gas extraction rate of a device can be increased, thereby increasing the energy efficiency level.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

DETAILED DESCRIPTION OF THE INVENTION

Figure 1:
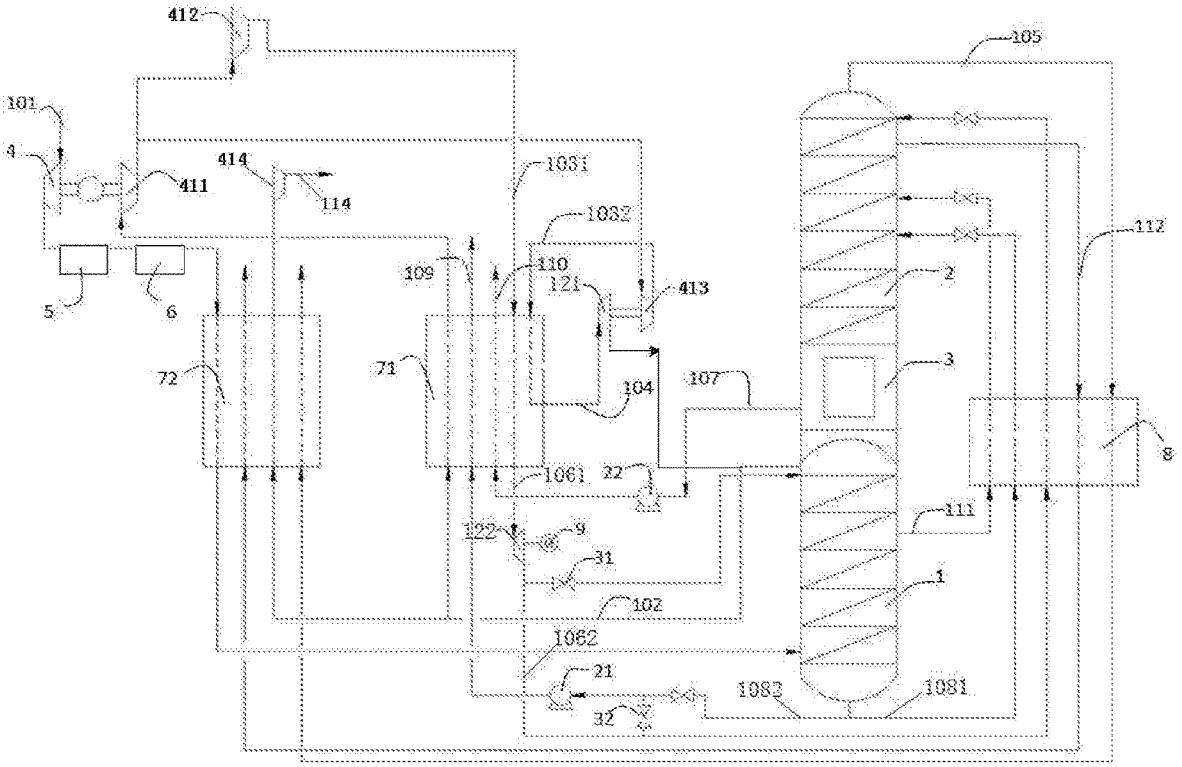
FIG. 1 is a structural schematic diagram of an apparatus of the present invention, wherein a portion of oxygen-rich liquid air is extracted from the first tower to produce an air product.

The present invention is described further below in conjunction with the drawings by means of particular embodiments, which are merely intended to explain the present invention without limiting the scope of protection thereof. In the present invention, the term "air feed gas" means a mixture containing mainly oxygen and nitrogen.

The term "impure nitrogen gas" covers gaseous fluids with a nitrogen content generally not lower than 95 mol %; the term "impure liquid nitrogen" means a liquid fluid with a molar percentage of nitrogen generally greater than 95.

The term "oxygen-rich liquid air" means a liquid fluid with a molar percentage of oxygen greater than 30; the term "liquid air" means a liquid fluid with a molar percentage of oxygen not greater than 30; the term "liquid oxygen" covers liquid fluids with a molar percentage of oxygen greater than 99, and the content of oxygen in "liquid oxygen" is higher than that in "oxygen-rich liquid air".

The cryogenic rectification of the present invention is a rectification method carried out at least in part at a temperature of 150 K or less. "Tower" herein means a distillation or fractionation tower or zone in which liquid and gas phases come into countercurrent contact to effectively separate a fluid mixture. The operating pressure of the "first tower" in the present invention is generally 5-6.5 bara, higher than the operating pressure of the "second tower" which is generally 1.1-1.5 bara. The second tower can be installed vertically at the top of the first tower or the two towers are installed side by side. The "first tower" is also generally referred to as a medium-pressure tower or a lower tower, and the "second tower" is also generally referred to as a low-pressure tower or an upper tower. The main condensing evaporator is generally located at the bottom of the "second tower", and it can make pure nitrogen gas produced at the top of the first tower condense by means of heat exchange with pure liquid oxygen produced at the bottom of the second tower to obtain pure liquid nitrogen at the top of the first tower, while the pure liquid oxygen is partially evaporated. Types of the main condensing evaporator include a tube and shell type, a falling film type, an immersion bath type, etc., and in the present invention, an immersion bath type condensing evaporator may be used.

The air pre-cooling system in the present invention is used for pre-cooling high-temperature air (70-120° C.) discharged from the main air compressor to a temperature suitable for entering the air purification system (generally 10-25° C.). High-temperature air generally comes into contact with ordinary circulating cooling water and low-temperature water (generally 5-20° C.) in an air cooling tower, thereby undergoing heat exchange, to achieve the purpose of cooling. Low-temperature water can be obtained by bringing ordinary circulating cooling water, for the purpose of heat exchange, into contact with gas products or by-products such as impure nitrogen gas produced by the air separation apparatus, or by means of a refrigerating machine.

The air purification system refers to a purification device that removes dust, water vapor, $CO_2$ and hydrocarbons, etc. from the air. In the present invention, a pressure swing adsorption method is generally used, wherein an adsorbent is involved which may optionally be a molecular sieve plus alumina, or a molecular sieve only.

In the main heat exchanger, the compressed, pre-cooled and purified air feed gas undergoes non-contact heat exchange with gas and/or liquid products produced by means of rectification, and is cooled to a temperature close to or equal to the rectification temperature of the first tower, generally less than 150 K. Common main heat exchangers include split or integrated types, etc. Main heat exchangers are divided into high-pressure (>20 bara pressure) and low-pressure (<20 bara pressure) heat exchangers according to suitable pressure ranges.

In the present invention, a high-pressure plate heat exchanger and a low-pressure plate heat exchanger or an integral combined heat exchanger may be used at the same time.

In the present invention, ultra-low pressure is generally 1-2 bara, low pressure is generally 2-10 bara, medium pressure is generally 10-50 bara, high pressure is generally 50-90 bara, and ultra-high pressure is generally 90 bara or more; a first nitrogen gas pressure is generally 2-10 bara, a second nitrogen gas pressure is generally 50-90 bara, a third nitrogen gas pressure is generally 50-90 bara, and a fourth nitrogen gas pressure is generally 1-2 bara.

As shown in FIG. 1, air feed gas 101 is pressurized to 6 bara by a main air compressor 4, then pre-cooled by a pre-cooling system 5 and purified by a purification system 6, and then sent into a low-pressure plate heat exchanger 72 to undergo indirect heat exchange with 1.1 bara ultra-low-pressure nitrogen gas (fourth nitrogen gas 105) coming from the top of a second tower 2 after rectification and 1.15 bara impure nitrogen gas 112 from an upper region of the second tower 2, and optionally with 5.2 bara low-pressure high-purity nitrogen gas (first nitrogen gas 102) from the top of a first tower 1, and after being cooled to about −176° C. is sent into a lower region of the first tower 1 to undergo rectification. A portion of the first nitrogen gas 102 extracted from the top of the first tower 1 is optionally sent into the low-pressure plate heat exchanger 72, and after being heated, is pressurized by a fourth nitrogen gas compressor 414 to obtain a medium-pressure high-purity nitrogen gas product 114; another portion of the first nitrogen gas 102 is heated via a high-pressure plate heat exchanger 71 to obtain 5.6 bara low-pressure high-purity nitrogen gas, which is then pressurized via a first nitrogen gas compressor 411 to obtain 40 bara medium-pressure high-purity nitrogen gas, of which a portion is sent into a second nitrogen gas compressor 412, and another portion is sent into a third nitrogen gas compressor 413. The second nitrogen gas compressor 412 continues to pressurize the medium-pressure high-purity nitrogen gas from the first nitrogen gas compressor 411 to obtain 80 bara high-pressure high-purity nitrogen gas 1031 (second nitrogen gas), which is then sent into the high-pressure plate heat exchanger 71, being cooled to obtain 80 bara high-purity liquid nitrogen (first liquid nitrogen 1061), which is depressurized by expansion via a second nitrogen gas expander 122 to obtain 6 bara high-purity liquid nitrogen (second liquid nitrogen 1062). A portion of the second liquid nitrogen 1062 is optionally further depressurized by expansion via a throttle valve 31 to obtain 5.3 bara high-purity liquid nitrogen which is sent into the top of the first tower 1 as reflux liquid; another portion of the second liquid nitrogen 1062 is supercooled via a supercooler 8 and then sent into the top of the second tower 2 as a reflux liquid. The third nitrogen gas compressor 413 continues to pressurize the medium-pressure high-purity nitrogen gas from the first nitrogen gas compressor 411 to obtain 60 bara high-pressure high-purity nitrogen gas 1032 (second nitrogen gas), which is then partially cooled via the high-pressure plate heat exchanger 71 to obtain 60 bara high-pressure high-purity nitrogen (third nitrogen gas 104), which is expanded via a first nitrogen gas expander 121 to obtain 5.2 bara high-purity nitrogen to be sent into the top of the first tower 1, and optionally sent into the top of the second tower 2. A portion of 6 bara oxygen-rich liquid air (first oxygen-rich liquid air 1081) containing 37% $O_2$ is extracted from the bottom of the first tower 1, and after being supercooled via the supercooler 8, is sent into the second tower 2 as reflux liquid. Another portion of 6 bara oxygen-rich liquid air (second oxygen-rich liquid air 1082) containing 37% $O_2$ is extracted from the bottom of the first tower 1, and is pressurized via a first pump 21 to obtain 80 bara high-pressure oxygen-rich liquid air, which is then sent into the high-pressure plate heat exchanger 71, being heated to obtain an 80 bara high-pressure air product 109. Optionally, a portion of the second liquid nitrogen 1062 that was depressurized via the second nitrogen gas expander 122 is mixed with the second oxygen-rich liquid air 1082 via a regulator valve 32, thereby adjusting the nitrogen-oxygen ratio in the outputted high-pressure air product 109. 1.4 bara liquid oxygen 107 (−180° C.) is extracted from a main condensing evaporator 3, and pressurized via a second pump 22 to obtain 80 bara high-pressure liquid oxygen 107, which is then sent into the high-pressure plate heat exchanger 71, being heated to obtain an 80 bara high-pressure oxygen gas product 110. 1.1 bara ultra-low-pressure nitrogen gas (fourth nitrogen gas 105) is extracted from the top of the first tower 1 and sequentially passes through the supercooler 8 and the low-pressure plate heat exchanger 72, being heated to obtain ultra-low-pressure nitrogen gas. Impure liquid nitrogen 111 is extracted from the first tower 1, supercooled via the supercooler 8, and then sent into the second tower 2 as reflux liquid. 1.15 bara impure nitrogen gas 112 is extracted from the second tower 2, and sequentially sent into the supercooler 8 and the low-pressure plate heat exchanger 72 for reheating.

In this embodiment, optionally, the second oxygen-rich liquid air 1082 extracted from the bottom of the first tower 1 is pressurized to different pressure ranges by first pumps 21 with different hydraulic heads, in order to output air products 109 in different pressure ranges. Also optionally, the second oxygen-rich liquid air 1082 is pressurized to different pressure ranges by connecting different numbers of first pumps 21 in series, in order to output the air product 109 in different pressure ranges. Optionally, the first liquid nitrogen 1061 can be depressurized by expansion via the second nitrogen gas expander 122 and/or the throttle valve 31, and then sent into the top of the first tower 1 and/or second tower 2. Optionally, the high-pressure plate heat exchanger 71 and the low-pressure plate heat exchanger 72 may be replaced by an integral combined heat exchanger as a main heat exchanger. The first nitrogen gas expander 121 is braked by means of the third nitrogen gas compressor 413 connected thereto; the second nitrogen gas expander 122 is braked by means of a generator 9 connected thereto. In this embodiment, the various materials all flow as transport media via pipelines connected between the apparatuses.

Figure 2:
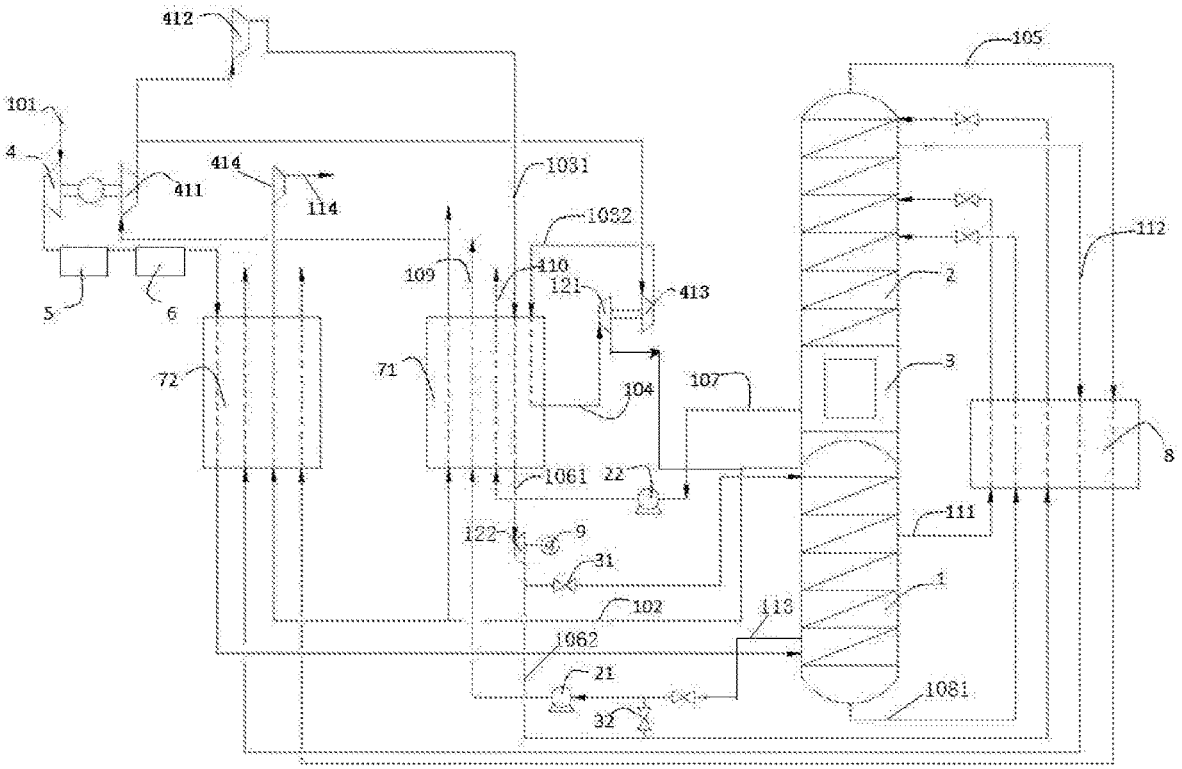
FIG. 2 is a structural schematic diagram of an apparatus of the present invention, wherein liquid air is extracted from the first tower to produce an air product.

The main difference between the embodiment shown in FIG. 2 and that shown in FIG. 1 is that different starting materials are used to produce the air product 109; in FIG. 2, liquid air 113 from the first tower 1 is selected to replace the oxygen-rich liquid air from the bottom of the first tower 1 in FIG. 1 for introduction into the first pump 21 to undergo pressurization. The rest of the embodiment shown in FIG. 2 is the same as in the embodiment shown in FIG. 1. Both are examples of the implementation of the present invention, but do not limit the spirit and scope of the present invention in any way. Specifically, in the embodiment shown in FIG. 2, air feed gas 101 is pressurized to 6 bara by a main air compressor 4, then pre-cooled by a pre-cooling system 5 and purified by a purification system 6, and then sent into a low-pressure plate heat exchanger 72 to undergo indirect heat exchange with 1.1 bara ultra-low-pressure nitrogen gas (fourth nitrogen gas 105) coming from the top of a second tower 2 after rectification and 1.15 bara impure nitrogen gas 112 from an upper region of the second tower 2, and optionally with 5.2 bara low-pressure high-purity nitrogen gas (first nitrogen gas 102) from the top of a first tower 1, and after being cooled to about −176° C. is sent into a lower region of the first tower 1 to undergo rectification. A portion of the first nitrogen gas 102 extracted from the top of the first tower 1 is optionally sent into the low-pressure plate heat exchanger 72, and after being heated, is pressurized by a fourth nitrogen gas compressor 414 to obtain a medium-pressure high-purity nitrogen gas product 114; another portion of the first nitrogen gas 102 is heated via a high-pressure plate heat exchanger 71 to obtain 5.6 bara low-pressure high-purity nitrogen gas, which is then pressurized via a first nitrogen gas compressor 411 to obtain 40 bara medium-pressure high-purity nitrogen gas, of which a portion is sent into a second nitrogen gas compressor 412, and another portion is sent into a third nitrogen gas compressor 413. The second nitrogen gas compressor 412 continues to pressurize the medium-pressure high-purity nitrogen gas from the first nitrogen gas compressor 411 to obtain 80 bara high-pressure high-purity nitrogen gas 1031 (second nitrogen gas), which is then sent into the high-pressure plate heat exchanger 71, being cooled to obtain 80 bara high-purity liquid nitrogen (first liquid nitrogen 1061), which is depressurized by expansion via a second nitrogen gas expander 122 to obtain 6 bara high-purity liquid nitrogen (second liquid nitrogen 1062). A portion of the second liquid nitrogen 1062 is optionally further depressurized by expansion via a throttle valve 31 to obtain 5.3 bara high-purity liquid nitrogen which is sent into the top of the first tower 1 as reflux liquid; another portion of the second liquid nitrogen 1062 is supercooled via a supercooler 8 and then sent into the top of the second tower 2 as a reflux liquid. The third nitrogen gas compressor 413 continues to pressurize the medium-pressure high-purity nitrogen gas from the first nitrogen gas compressor 411 to obtain 60 bara high-pressure high-purity nitrogen gas 1032 (second nitrogen gas), which is then partially cooled via the high-pressure plate heat exchanger 71 to obtain 60 bara high-pressure high-purity nitrogen (third nitrogen gas 104), which is expanded via a first nitrogen gas expander 121 to obtain 5.2 bara high-purity nitrogen to be sent into the top of the first tower 1, and optionally sent into the top of the second tower 2. 6 bara oxygen-rich liquid air (first oxygen-rich liquid air 1081) containing 37% $O_2$ is extracted from the bottom of the first tower 1, and after being supercooled via the supercooler 8, is sent into the second tower 2 as reflux liquid. 6 bara liquid air 113 (with a molar percentage of oxygen no greater than 30) is extracted from the first tower 1, and pressurized via a first pump 21 to obtain 80 bara high-pressure oxygen-rich liquid air, which is then sent into the high-pressure plate heat exchanger 71, being heated to obtain an 80 bara high-pressure air product 109. Optionally, a portion of the second liquid nitrogen 1062 that was depressurized via the second nitrogen gas expander 122 is mixed with the liquid air 113 via a regulator valve 32, thereby adjusting the nitrogen-oxygen ratio in the outputted high-pressure air product 109. 1.4 bara liquid oxygen 107 (−180° C.) is extracted from a main condensing evaporator 3, and pressurized via a second pump 22 to obtain 80 bara high-pressure liquid oxygen 107, which is then sent into the high-pressure plate heat exchanger 71, being heated to obtain an 80 bara high-pressure oxygen gas product 110. 1.1 bara ultra-low-pressure nitrogen gas (fourth nitrogen gas 105) is extracted from the top of the first tower 1 and sequentially passes through the supercooler 8 and the low-pressure plate heat exchanger 72, being heated to obtain ultra-low-pressure nitrogen gas. Impure liquid nitrogen 111 is extracted from the first tower 1, supercooled via the supercooler 8, and then sent into the second tower 2 as reflux liquid. 1.15 bara impure nitrogen gas 112 is extracted from the second tower 2, and sequentially sent into the supercooler 8 and the low-pressure plate heat exchanger 72 for reheating.

In this embodiment, optionally, the liquid air 113 extracted from the bottom of the first tower 1 is pressurized to different pressure ranges by first pumps 21 having different hydraulic heads, in order to output the air product 109 in different pressure ranges. Also optionally, the liquid air 113 is pressurized to different pressure ranges by connecting different numbers of first pumps 21 in series, in order to output the air product 109 in different pressure ranges. Optionally, the first liquid nitrogen 1061 can be depressurized by expansion via the second nitrogen gas expander 122 and/or the throttle valve 31, and then sent into the top of the first tower 1 and/or second tower 2. Optionally, the high-pressure plate heat exchanger 71 and the low-pressure plate heat exchanger 72 may be replaced by an integral combined heat exchanger as a main heat exchanger. The first nitrogen gas expander 121 is braked by means of the third nitrogen gas compressor 413 connected thereto; the second nitrogen gas expander 122 is braked by means of a generator 9 connected thereto. In this embodiment, the various materials all flow as transport media via pipelines connected between the apparatuses.

Although the content of the present invention has been presented in detail by means of the preferred embodiments above, it should be recognized that the descriptions above should not be regarded as limiting the present invention. Various amendments and substitutions to the present invention will be obvious after perusal of the content above by those skilled in the art. Thus, the scope of protection of the present invention should be defined by the attached claims.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for producing an air product on the basis of cryogenic rectification, the method comprising the steps of:

a. providing a first tower and a second tower, the top of the first tower being in communication by heat exchange with the bottom of the second tower by means of a main condensing evaporator, and an operating pressure of the first tower being higher than an operating pressure of the second tower;

b. providing a main air compressor, an air pre-cooling system, an air purification system, a main heat exchanger, at least one nitrogen gas compressor, a supercooler, and at least one nitrogen gas expander;

c. subjecting an air feed gas, which has been pressurized via the main air compressor, to further pre-cooling and purification, then cooling said air feed gas in the main heat exchanger before introducing into the first tower to undergo rectification;

d. extracting a first nitrogen gas at the top of the first tower or second tower, reheating the first nitrogen gas via the main heat exchanger, then pressurizing the first nitrogen gas via the at least one nitrogen gas compressor to form a second nitrogen gas; at least a portion of the second nitrogen gas being cooled in the main heat exchanger to form a first liquid nitrogen, which is depressurized via a depressurization device to form a second liquid nitrogen which is sent into the top of the first tower and/or the second tower; at least another portion of the second nitrogen gas being partially cooled in the main heat exchanger to form a third nitrogen gas, which is expanded via a first nitrogen gas expander and then sent into the top of the first tower and/or the second tower;

e. extracting a first oxygen-rich liquid air from the first tower, supercooling the first oxygen-rich liquid air via the supercooler, and then sending into the second tower as reflux liquid;

wherein a second oxygen-rich liquid air or liquid air is extracted from the first tower and pressurized via a first pump, then undergoes heat exchange with the second nitrogen gas in the main heat exchanger, and an air product is then outputted.

2. The method as claimed in claim 1, wherein the second oxygen-rich liquid air or liquid air is pressurized to different pressure ranges by using first pumps with different hydraulic heads, in order to output air products in different pressure ranges.

3. The method as claimed in claim 1, wherein the second oxygen-rich liquid air or liquid air is pressurized to different pressure ranges by connecting different numbers of first pumps in series, in order to output air products in different pressure ranges.

4. The method as claimed in claim 1, wherein a portion of the second liquid nitrogen is led out to the first pump via a regulator valve, for the purpose of being mixed with the second oxygen-rich liquid air or liquid air in a suitable ratio, thereby adjusting the nitrogen-oxygen ratio in the outputted air product.

5. The method as claimed in claim 1, wherein liquid oxygen is extracted in the main condensing evaporator, pressurized via a second pump and then sent into the main heat exchanger to be vaporized, and an oxygen gas product is then outputted.

6. The method as claimed in claim 1, wherein a portion of the second liquid nitrogen is led out, supercooled via the supercooler and then sent into the top of the second tower.

7. The method as claimed in claim 1, wherein impure liquid nitrogen is extracted at a middle region of the first tower, supercooled via the supercooler and then sent into the second tower as reflux liquid; impure nitrogen gas is extracted from the second tower, heated via the supercooler, and then further sent into the main heat exchanger for reheating; fourth nitrogen gas is extracted from the top of the second tower, heated via the supercooler, and then further sent into the main heat exchanger for reheating.

8. The method as claimed in claim 1, wherein the depressurization device is a second nitrogen gas expander and/or a throttle valve.

9. The method as claimed in claim 8, wherein the first nitrogen gas expander is braked by means of the at least one nitrogen gas compressor; the second nitrogen gas expander is braked by means of a generator.

10. An apparatus for producing an air product on the basis of cryogenic rectification, the apparatus comprising:

a. a first tower and a second tower, the top of the first tower being in communication by heat exchange with the bottom of the second tower by means of a main condensing evaporator, and an operating pressure of the first tower being higher than an operating pressure of the second tower;

b. a main air compressor, an air pre-cooling system, an air purification system, a main heat exchanger, at least one nitrogen gas compressor, a supercooler, and at least one nitrogen gas expander;

c. a pipeline which connects air feed gas into the first tower via the main air compressor, the air pre-cooling system, the air purification system and the main heat exchanger;

d. a pipeline which connects first nitrogen gas from the top of the first tower or second tower into the main heat exchanger, at least one nitrogen gas compressor, the main heat exchanger again, and a first nitrogen gas expander or a depressurization device before being recycled to the first tower and/or the second tower;

e. a pipeline which connects first oxygen-rich liquid air from the first tower into the second tower via the supercooler;

f. a pipeline which outputs second oxygen-rich liquid air or liquid air from the first tower via a first pump and the main heat exchanger.

11. The apparatus as claimed in claim 10, further comprising a pipeline which is connected between an outlet of the depressurization device and an inlet of the first pump and contains a regulator valve.

12. The apparatus as claimed in claim 10, further comprising a pipeline which outputs liquid oxygen from the main condensing evaporator via a second pump and the main heat exchanger.

13. The apparatus as claimed in claim 10, further comprising a pipeline which is led out from an outlet of the depressurization device and connected into the top of the second tower via the supercooler.

14. The apparatus as claimed in claim 10, further comprising a pipeline which connects impure liquid nitrogen from a middle region of the first tower into the second tower via the supercooler, a pipeline which connects impure nitrogen gas from the second tower into the main heat exchanger via the supercooler, and a pipeline which connects fourth nitrogen gas from the top of the second tower into the main heat exchanger via the supercooler.

15. The apparatus as claimed in claim 10, wherein the depressurization device is a second nitrogen gas expander and/or a throttle valve.

16. The apparatus as claimed in claim 15, wherein the first nitrogen gas expander is connected to the nitrogen gas compressor; the second nitrogen gas expander is connected to a generator.

17. The apparatus as claimed in claim 10, wherein the main heat exchanger comprises a high-pressure plate heat exchanger and a low-pressure plate heat exchanger, or an integral combined heat exchanger.

* * * * *